US007188370B2

(12) United States Patent
Bevier

(10) Patent No.: US 7,188,370 B2
(45) Date of Patent: Mar. 13, 2007

(54) PROTECTIVE DEVICE

(75) Inventor: Joseph J. Bevier, Portland, OR (US)

(73) Assignee: Nike Inc., Beaverton, OR (US)

( * ) Notice: Subject to any disclaimer, the term of this patent is extended or adjusted under 35 U.S.C. 154(b) by 449 days.

(21) Appl. No.: 10/840,661

(22) Filed: May 7, 2004

(65) Prior Publication Data

US 2005/0246812 A1 Nov. 10, 2005

(51) Int. Cl.
*A41D 13/00* (2006.01)

(52) U.S. Cl. ..... 2/22

(58) Field of Classification Search ..... 2/16, 2/22, 24, 455, 62, 242, 908, 911; 128/878, 128/882; 602/16, 20, 23, 26, 62
See application file for complete search history.

(56) References Cited

U.S. PATENT DOCUMENTS 3,735,419 A 5/1973 Byrd
3,761,960 A 10/1973 Woodcock
4,692,946 A 9/1987 Jurga
D297,178 S 8/1988 Jurga
4,888,826 A 12/1989 Parsons, Jr. et al.
5,452,475 A 9/1995 Hunt
5,611,080 A * 3/1997 Skottheim ..... 2/16
D451,644 S 12/2001 Fujimoto et al.

* cited by examiner

*Primary Examiner*—Tejash Patel
(74) *Attorney, Agent, or Firm*—Banner & Witcoff Ltd.

(57) ABSTRACT

A protective device is disclosed that may have the configuration of a leg protector, for example. As a leg protector, the protective device includes a knee portion, a first thigh portion, and a second thigh portion. The first thigh portion is positioned adjacent the knee portion and has an elastic member. The second thigh portion is positioned adjacent the first thigh portion and opposite the knee portion. The knee portion, the first thigh portion, and the second thigh portion are secured relative to each other with at least one flexible strap that is attached to the knee portion, attached to the elastic member of the first thigh portion, and attached to the second thigh portion. The strap is unattached to the first thigh portion. In some embodiments, the first thigh portion does not include a restraint for securing the leg protector to the leg.

29 Claims, 4 Drawing Sheets

PROTECTIVE DEVICE

BACKGROUND OF THE INVENTION

1. Field of the Invention

The present invention relates to protective devices for shielding or otherwise protecting individuals. The invention has application to protective devices that are suitable for use in athletic activities.

2. Description of Background Art

Individuals that engage in various athletic activities, such as football, hockey, and baseball, for example, wear protective devices that guard against potentially injurious contact with other individuals or objects. For example, a player in the sport of football wears various protective devices (e.g., helmet, shoulder pads, and thigh pads) to prevent or otherwise limit injuries that may occur as a result of contact with other players. A goalkeeper in the sport of hockey generally wears various forms of protective devices (e.g., helmet, gloves, and leg protectors) to prevent injuries arising from contact with the puck or the hockey sticks of other players. Similarly, a catcher in the sport of baseball generally wears a pair of protective devices (i.e., leg protectors) that guard the legs against contact with a baseball.

An exemplary prior art leg protector is disclosed in U.S. Pat. No. 4,692,946 to Jurga as including a foot guard, a shin guard, a knee guard, a first thigh guard, and a second thigh guard. Each of the guards are formed from a semi-rigid plate and a padded member positioned on one side of the plate. Whereas the padded members are placed in contact with the individual, the plates face outward. The leg protector also includes a plurality of restraints extending from edges of the guards that are intended to extend around the leg of the individual, thereby securing the leg protector to the leg.

In addition to preventing or otherwise limiting injuries that occur during the course of engaging in the sport of baseball, leg protectors should remain properly positioned on the individual while permitting the individual to freely move. That is, the leg protectors should not limit or otherwise restrain movements of the individual, but the leg protectors should remain positioned in order to impart protection against contact with a baseball. Referring to the Jurga patent, a pair of straps extend vertically from the knee guard to the second thigh guard, and the straps are secured to the first thigh guard.

SUMMARY OF THE INVENTION

The present invention is a protective device that includes a first portion, a second portion, and a third portion. In some embodiments, the first portion may cover at least a portion of a knee of an individual, and the second portion and the third portion may cover at least a portion of a thigh of the individual. The second portion is positioned adjacent the first portion, and the second portion has an elastic member. The third portion is positioned adjacent the second portion and opposite the first portion. The first portion, the second portion, and the third portion are secured relative to each other with at least one flexible strap that is attached to the first portion, attached to the elastic member of the second portion, and attached to the third portion.

Each of the first portion, the second portion, and the third portion may include (1) a plate that is formed from a semi-rigid polymer material and (2) a pad that includes a polymer foam material. The elastic member may, therefore, be secured to the pad of the second portion, and the elastic member may be a strip of an elastic material that extends across the first thigh portion. In addition, the elastic member may be secured to a surface of the second portion such that the flexible strap is unattached to the second portion, and the flexible strap may be formed from a substantially inextensible material. The flexible strap may be a pair of straps that are substantially parallel to each other, with the pair of straps being attached to the elastic member and unattached to the second portion.

In some embodiments, the first portion includes a first restraint and the third portion includes a third restraint. The first restraint and the third restraint have a configuration that extends around an area of an individual, such as the leg, and secures the protective device to the individual. The second portion does not, however, include a second restraint for extending around the individual.

The advantages and features of novelty characterizing the present invention are pointed out with particularity in the appended claims. To gain an improved understanding of the advantages and features of novelty, however, reference may be made to the following descriptive matter and accompanying drawings that describe and illustrate various embodiments and concepts related to the invention.

DESCRIPTION OF THE DRAWINGS

The foregoing Summary of the Invention, as well as the following Detailed Description of the Invention, will be better understood when read in conjunction with the accompanying drawings.

DETAILED DESCRIPTION OF THE INVENTION

Figure 1:
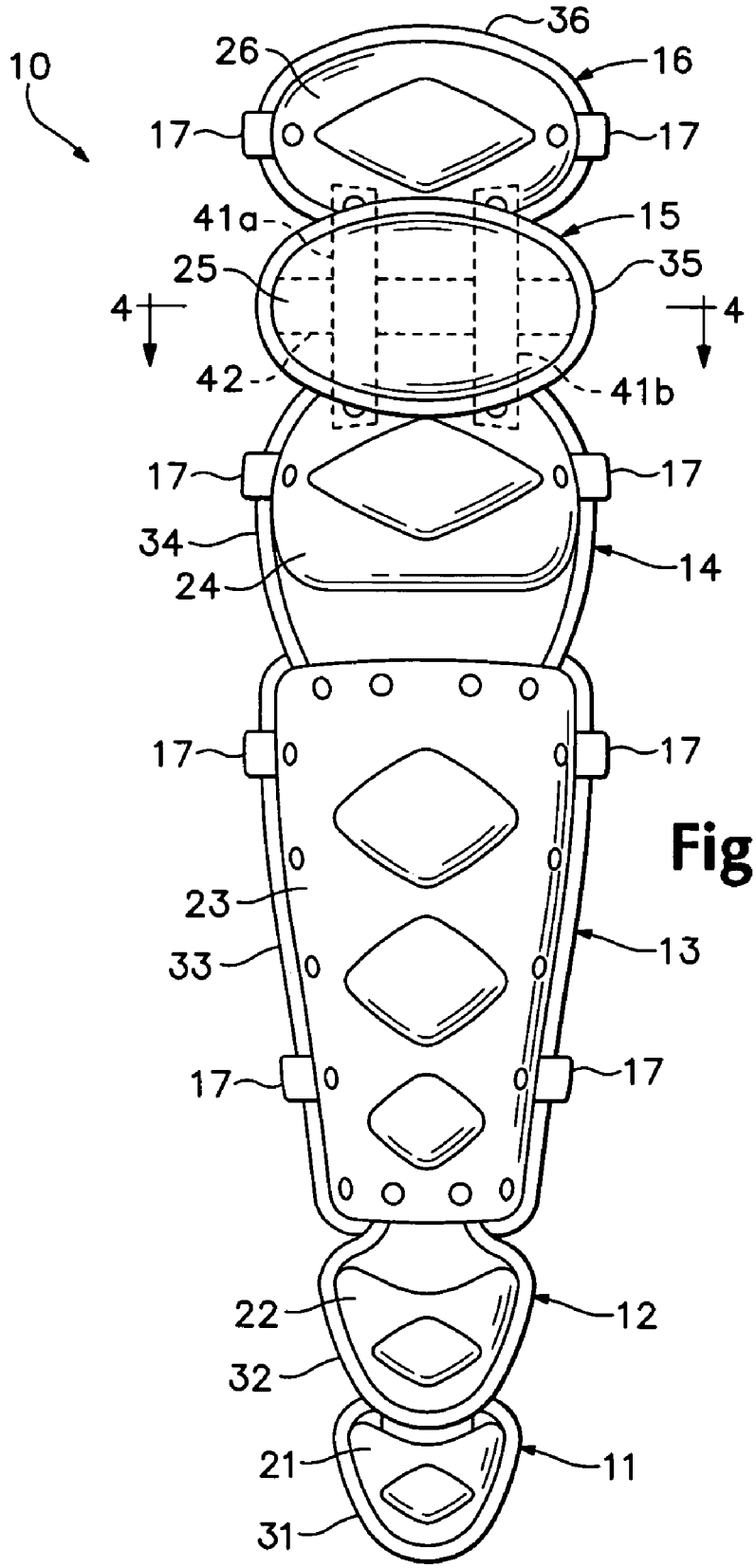
FIG. 1 is a front elevational view of a protective device in accordance with the present invention.

The following discussion and accompanying figures disclose a protective device 10 for athletic activities. Protective device 10 is disclosed as having a configuration of a leg protector that shields a leg area of an individual, particularly a catcher in the sport of baseball, from contact with a baseball. The concepts associated with protective device 10 may be applied, however, to protective devices that are also suitable for protecting other areas of the individual, including an arm area, for example. In addition, the concepts associated with protective device 10 may be applied to protective devices for a variety of other athletic activities. For example, a protective device with a similar structure may be utilized to protect a goalkeeper in the sport of hockey, or to protect a player in the sport of football. In addition, the concepts associated with protective device 10 may be applied to various non-athletic protective devices, such as protective devices that are utilized by law enforcement or the military, for example. Accordingly, the concepts associated with protective device 10 may be utilized to protect various areas of the individual and may be applied to protective devices that are suitable for a wide range of athletic and non-athletic activities.

Protective device 10 has the configuration of a leg protector that shields or otherwise protects the leg area of the individual. More particularly, protective device 10 is intended to cover portions of the foot, ankle, lower leg, knee, and thigh of the individual. In order to permit the individual to freely move, protective device 10 has a generally articulated structure that imparts flexibility at the knee. That is, the area of protective device 10 that is associated with the knee accommodates bending or rotation of the leg area at the knee. In addition to accommodating bending or rotation at the knee, protective device 10 also has a structure that remains properly positioned with respect to the leg area when the knee is bent. Accordingly, protective device 10 operates to shield the leg area of the individual through a full range of motion of the leg area, as described in greater detail below.

Protective device 10 includes a pair of foot portions 11 and 12, a shin portion 13, a knee portion 14, a first thigh portion 15, and a second thigh portion 16. In addition, protective device 10 includes various restraints 17 with a generally conventional structure that extend from portions 13, 14, and 16 to secure protective device 10 to the leg area. Foot portions 11 and 12 shield portions of the foot of the individual. More particularly, foot portion 11 is configured to extend over a lower instep area of the foot, and foot portion 12 is configured to extend over an upper instep area of the foot, thereby shielding the instep area from contact with the baseball. Shin portion 13 is secured to foot portion 12 and extends from the ankle to the knee, thereby shielding the lower leg. Knee portion 14 is secured to shin portion 13 opposite foot portion 12 and generally shields the knee. First thigh portion 15 is secured to knee portion 14 and shields an area of the thigh that is adjacent to the knee. Similarly, second thigh portion 16 is secured to first thigh portion 15 and shields another area of the thigh. Accordingly, protective device 10 shields or otherwise protects various portions of the foot, ankle, lower leg, knee, and thigh of the individual.

Foot portion 11 is formed of a plate 21 and a pad 31. Plate 21 is formed from a semi-rigid and durable material that is capable of withstanding multiple impacts from a baseball and a baseball bat, for example. Examples of suitable materials for plate 21 include polyethylene, polypropylene, acrylonitrile butadiene styrene, polyester, thermoset urethane, thermoplastic urethane, various nylon formulations, blends of these materials, or blends that include glass fibers. In addition, plate 21 may be formed from a high flex modulus polyether block amide, such as PEBAX, which is manufactured by the Atofina Company. Polyether block amide provides a variety of characteristics that benefit the present invention, including high impact resistance at low temperatures, few property variations in the temperature range of −40 degrees Celsius to positive 80 degrees Celsius, resistance to degradation by a variety of chemicals, and low hysteresis during alternative flexure. Another suitable material for plate 21 is a blend of polyether block amide and nylon with glass fiber reinforcement. Furthermore, plate 21 may be formed from a polybutylene terephthalate, such as HYTREL, which is manufactured by E.I. duPont de Nemours and Company. Composite materials may also be formed by incorporating glass fibers or carbon fibers into the polymer materials discussed above in order to enhance the strength of plate 21. Pad 31 may be formed from a polymer foam material with a textile covering that provides a cushion between the foot and plate 21, thereby enhancing the comfort of foot portion 11. In addition, pad 31 attenuates shock and absorbs energy when the baseball or baseball bat contacts foot portion 11. Suitable polymer foam materials for pad 31 include various formulations of polyurethane or ethylvinylacetate foams, for example. Pad 31 is secured to a surface of plate 21 with a suitable adhesive, stitching, rivets, or a combination thereof, for example.

Each of portions 12–16 exhibit the general configuration discussed above with respect to foot portion 11. Accordingly, foot portion 12 also includes a plate 22 and a pad 32. Similarly, portions 13–16 respectively include plates 23–26 and pads 33–36. As with plate 21, each of plates 22–26 may be formed from a semi-rigid and durable material that is capable of withstanding multiple impacts from a baseball and a baseball bat. Similarly, each of pads 32–36 may be formed from a polymer foam material with a textile covering. In some embodiments, the materials utilized or the thicknesses of the materials for each of plates 21–26 and pads 31–36 may vary significantly. In addition, the manner in which plates 21–26 are respectively secured to pads 31–36 may vary. For example, shin portion 13 may have a structure wherein all or a portion of pad 33 is secured with a hook-and-loop fastener that permits the individual to selectively reposition pad 33. Furthermore, pad 33 and pad 34 may be formed of unitary (i.e., one-piece) construction in some embodiments. Accordingly, the general structure of the various portions 12–16 may vary significantly within the scope of the present invention.

First thigh portion 15 overlaps an upper area of knee portion 14 and also overlaps a lower area of second thigh portion 16. Accordingly, first thigh portion 15 is positioned in front of knee portion 14 and second thigh portion 16, with a back surface of first thigh portion 15 generally contacting a front surface of knee portion 14 and second thigh portion 16. This configuration places first thigh portion on a different plane than knee portion 14 and second thigh portion 16, thereby permitting each of knee portion 14 and second thigh portion 16 to slide or otherwise move relative to first thigh portion 15 as the individual flexes the knee.

An attachment system secures portions 14–16 to each other and includes a strap 41*a*, a strap 41*b*, and a connecting member 42. Each of straps 41*a* and 41*b* are secured to the upper area of knee portion 14 and are also secured to the lower area of second thigh portion 16. Accordingly, straps 41*a* and 41*b* are generally parallel to each other and extend vertically between knee portion 14 and second thigh portion 16. In securing strap 41*a* to knee portion 14, a variety of attachment method may be employed. For example, an end area of strap 41*a* may be positioned between plate 24 and pad 34, and the end area may be riveted to plate 24. Alternatively, stitching or an adhesive may be utilized. Similar attachment methods may be employed to secure strap 41*b* to knee portion 14 and to secure each of straps 41*a* and 41*b* to second thigh portion 16.

Connecting member 42 is formed from a strip of a generally elastic material and extends in a generally horizontal direction across a rear surface of first thigh portion 15. Stitching 43 is utilized in at least three locations to secure connecting member 42 to first thigh portion 15. More particularly, stitching 43 secures connecting member 42 to pad 35. Straps 41*a* and 41*b* extend between connecting member 42 and pad 35, and stitching 44*a* and 44*b* is respectively utilized to join straps 41*a* and 41*b* to connecting member 42. Stitching 44*a* and 44*b* extends through connecting member 42 and respectively through straps 41*a* and 41*b*, but does not extend into first thigh portion 15. Accordingly, straps 41*a* and 41*b* are not directly secured to first thigh portion 15, but are secured to first thigh portion 15 through connecting member 42. In some embodiments, however, stitching 44*a* and 44*b* may extend through connecting member 42, respectively through straps 41*a* and 41*b*, and also into first thigh portion 15.

Straps 41*a* and 41*b* may be formed from a nylon webbing material that is substantially inextensible. In some embodiments, straps 41*a* and 41*b* may be formed from strips of a polymer sheet or formed from leather, for example. Connecting member 42 is formed from a strip of a generally elastic material that stretches in response to tensile forces. In order to provide stretch and recovery properties to connecting member 42, and particularly the material that forms connecting member 42, yarns that incorporate an elastane fiber may be utilized. Elastane fibers are available from E.I. duPont de Nemours Company under the LYCRA trademark, for example. In addition, connecting member 42 may be formed from a rubber material that also exhibits stretch and recovery properties. In some embodiments, connecting member 42 may be formed from a non-extensible material, and straps 41*a* and 41*b* may be formed from an elastic material. In other embodiments, strap 41*a*, strap 41*b*, and connecting member 42 may each be formed from an elastic material.

Figure 2:
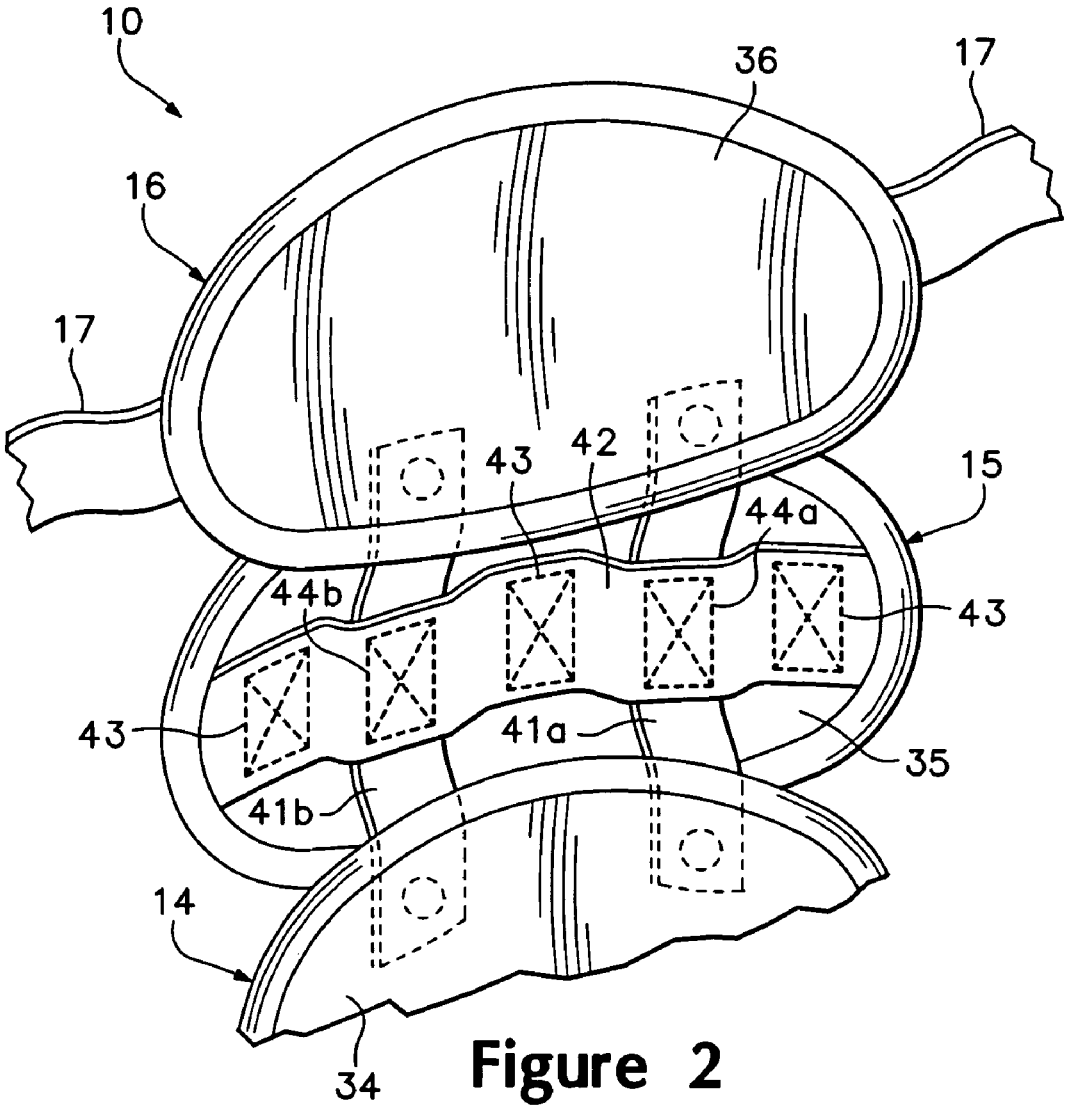
FIG. 2 is a partial back perspective view of the protective device.
Figure 3:
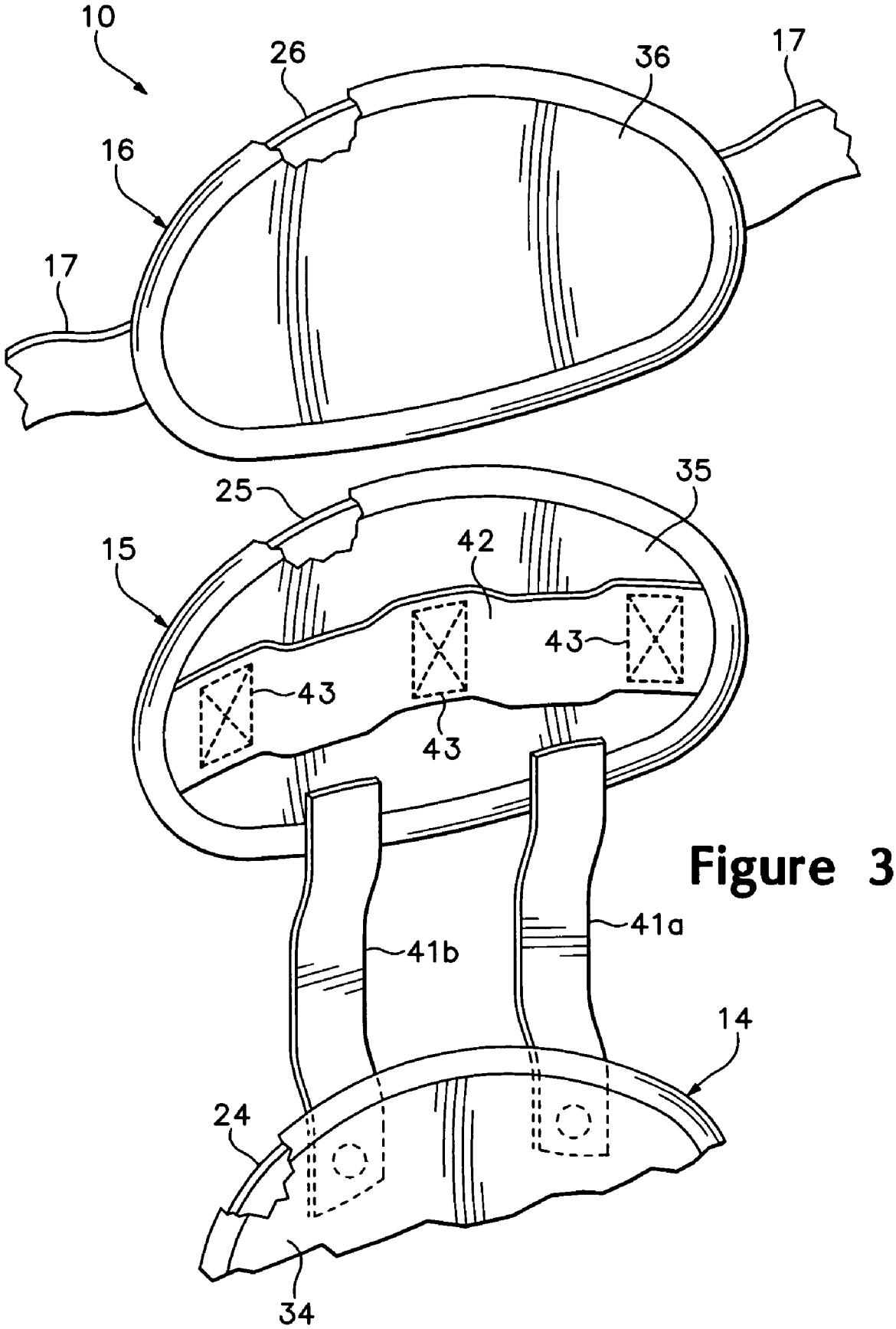
FIG. 3 is an exploded partial back perspective view of the protective device.
Figure 4:
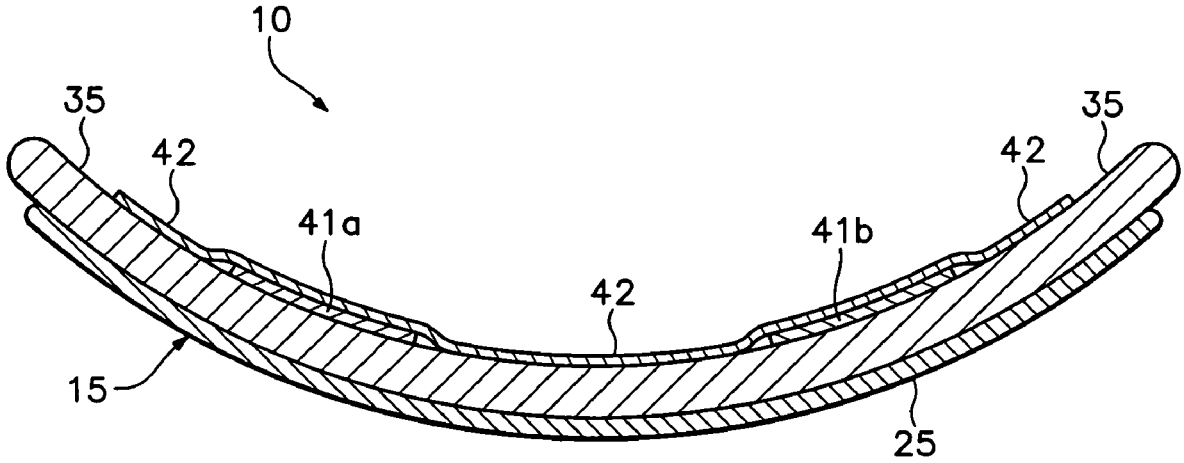
FIG. 4 is a cross-sectional view of the protective device, as defined by section line 4—4 in FIG. 1.

The configuration discussed above for the attachment system (i.e., straps 41*a* and 41*b* and connecting member 42) imparts flexibility to protective device 10 that permits the individual to flex or otherwise bend the knee. This configuration also securely positions each of portions 14–16 relative to each other, while permitting portions 14–16 to move in response to movements of the individual. When the individual is standing with an unflexed leg, portions 14–16 are positioned in the manner depicted in FIGS. 1 and 2. When the individual crouches, walks, or otherwise bends at the knee, (1) first thigh portion 15 and second thigh portion 16 both rotate relative knee portion 14 and (2) the positions of portions 14–16 move relative to each other, which has an effect of separating portions 14–16. The inextensible characteristics of straps 41*a* and 41*b* limits the degree to which portions 14 and 16 may separate. The elastic characteristics of connecting member 42, however, permits first thigh portion 15 to move relative to each of portions 14 and 16. The limited degree of elasticity in connecting member 42 restrains first thigh portion 15 from moving to a significant degree that exposes a portion of the leg area to the baseball or a baseball bat. That is, connecting member 42 permits first thigh portion 15 to move to a limited degree, but prevents significant movement. In effect, therefore, first thigh portion 15 floats relative to portions 14 and 16, but is restrained from significant movement.

Connecting member 42 is discussed above and depicted in the figures as being a strip of the elastic material. In further embodiments, connecting member 42 may be two elements of the elastic material, with straps 41*a* and 41*b* each being associated with one of the elements. In addition, connecting member 42 may be a variety of other elements that join straps 41*a* and 41*b* to first thigh portion in an elastic manner.

Many prior art leg protectors, including the leg protector disclosed in U.S. Pat. No. 4,692,946 to Jurga (see the Background of the Invention section) utilize restraints on each of the shin, knee, and two thigh portions. One less restraint may be utilized in the configuration disclosed with respect to protective device 10. That is, each of portions 13, 14, and 16 incorporate a restraint 17, but the configuration of straps 41*a* and 41*b* and connecting member 42 provides a structure wherein no restraint is needed for first thigh portion 15.

The general concepts disclosed above may be applied to a variety of protective devices, in addition to protective device 10. For example, a protective device with a similar configuration may be utilized to protect other areas of the individual that bend, including the torso, elbow, and shoulder, for example. Accordingly, the concepts disclosed with respect to protective device 10 may be incorporated into chest protectors, back protectors, elbow protectors, and shoulder protectors. The general concepts disclosed above may also be applied to protective devices that are not intended to be used with a jointed or otherwise flexible area of the individual. Accordingly, the general concepts disclosed above may be applied to a variety of protective devices.

The present invention is disclosed above and in the accompanying drawings with reference to a variety of embodiments. The purpose served by the disclosure, however, is to provide an example of the various features and concepts related to the invention, not to limit the scope of the invention. One skilled in the relevant art will recognize that numerous variations and modifications may be made to the embodiments described above without departing from the scope of the present invention, as defined by the appended claims.

That which is claimed is:

1. A leg protector comprising:

a knee portion for covering at least a portion of a knee of an individual;

a first thigh portion for covering at least a first portion of a thigh of the individual, the first thigh portion being positioned adjacent the knee portion, and the first thigh portion having an elastic member; and a second thigh portion for covering at least a second portion of the thigh, the second thigh portion being positioned adjacent the first thigh portion and opposite the knee portion, the knee portion, the first thigh portion, and the second thigh portion being secured relative to each other with at least one flexible strap that is attached to the knee portion, attached to the elastic member of the first thigh portion, and attached to the second thigh portion wherein the elastic member is secured to a surface of the first thigh portion and the at least one flexible strap is unattached to the first thigh portion.

2. The leg protector recited in claim 1, wherein each of the knee portion, the first thigh portion, and the second thigh portion include:

a plate that is formed from a semi-rigid polymer material; and a pad that includes a polymer foam material.

3. The leg protector recited in claim 2, wherein the elastic member is secured to the pad of the first thigh portion.

4. The leg protector recited in claim 1, wherein the at least one flexible strap extends between the elastic member and the first thigh portion.

5. The leg protector recited in claim 1, wherein the at least one flexible strap is a pair of straps that are substantially parallel to each other.

6. The leg protector recited in claim 5, wherein the pair of straps are attached to the elastic member and unattached to the first thigh portion.

7. The leg protector recited in claim 5, wherein the pair of straps extend between the elastic member and the first thigh portion.

8. The leg protector recited in claim 1, wherein the at least one flexible strap is formed from a substantially inextensible material.

9. The leg protector recited in claim 1, wherein the knee portion includes a first restraint and the second thigh portion includes a second restraint, the first restraint and the second restraint having a configuration that extends around the individual and secures the leg protector to the individual, and the first thigh portion does not include a third restraint for extending around the individual.

10. The leg protector recited in claim 1, wherein the elastic member is a strip of an elastic material that extends across the first thigh portion.

11. A leg protector comprising:

a knee portion for covering at least a portion of a knee of an individual;

a first thigh portion for covering at least a first portion of a thigh of the individual, the first thigh portion being positioned adjacent the knee portion;

a second thigh portion for covering at least a second portion of the thigh, the second thigh portion being positioned adjacent the first thigh portion and opposite the knee portion;

an elastic member extending across the first thigh portion, the elastic member being formed as at least one strip of an elastic material;

a pair of straps that are each secured to the knee portion and the second thigh portion, the straps extending between the elastic member and the first thigh portion, and the straps being secured to the elastic member and unsecured to the first thigh portion.

12. The leg protector recited in claim 11, wherein each of the knee portion, the first thigh portion, and the second thigh portion include:

a plate that is formed from a semi-rigid polymer material; and a pad that includes a polymer foam material.

13. The leg protector recited in claim 12, wherein the elastic member is secured to the pad of the first thigh portion.

14. The leg protector recited in claim 11, wherein the elastic member is secured to a surface of the first thigh portion.

15. The leg protector recited in claim 11, wherein the straps are substantially parallel to each other.

16. The leg protector recited in claim 11, wherein the straps are formed from a substantially inextensible material.

17. The leg protector recited in claim 11, wherein the straps are formed from a webbing material.

18. The leg protector recited in claim 11, wherein the knee portion includes a first restraint and the second thigh portion includes a second restraint, the first restraint and the second restraint having a configuration that extends around the individual and secures the leg protector to the individual, and the first thigh portion does not include a third restraint for extending around the individual.

19. A leg protector for protecting a leg of an individual, the leg protector comprising:

a knee portion for covering at least a portion of a knee of an individual, the knee portion including a first restraint with a configuration for extending around the leg and securing the leg protector to the leg;

a first thigh portion for covering at least a first portion of a thigh of the individual, the first thigh portion being positioned adjacent the knee portion, and the first thigh portion having an elastic member; and a second thigh portion for covering at least a second portion of the thigh, the second thigh portion being positioned adjacent the first thigh portion and opposite the knee portion, and the second thigh portion including a second restraint with a configuration for extending around the leg and securing the leg protector to the leg, the knee portion, the first thigh portion, and the second thigh portion being secured relative to each other with at least one flexible strap that is attached to the knee portion, attached to the elastic member of the first thigh portion, unattached to the first thigh portion, and attached to the second thigh portion, and the first thigh portion not including a third restraint for extending around the leg.

20. The leg protector recited in claim 19, wherein each of the knee portion, the first thigh portion, and the second thigh portion include:

a plate that is formed from a semi-rigid polymer material; and a pad that includes a polymer foam material.

21. The leg protector recited in claim 20, wherein the elastic member is secured to the pad of the first thigh portion.

22. The leg protector recited in claim 19, wherein the elastic member is secured to a surface of the first thigh portion, and the at least one flexible strap is unattached to the first thigh portion.

23. The leg protector recited in claim 19, wherein the at least one flexible strap extends between the elastic member and the first thigh portion, and the at least one flexible strap is unattached to the first thigh portion.

24. The leg protector recited in claim 19, wherein the at least one flexible strap is a pair of straps that are substantially parallel to each other.

25. The leg protector recited in claim 24, wherein the pair of straps are attached to the elastic member and unattached to the first thigh portion.

26. The leg protector recited in claim 25, wherein the pair of straps extend between the elastic member and the first thigh portion.

27. The leg protector recited in claim 19, wherein the at least one flexible strap is formed from a substantially inextensible material.

28. The leg protector recited in claim 19, wherein the elastic member is a strip of an elastic material that extends across the first thigh portion.

29. A leg protector comprising:

a knee portion for covering at least a portion of a knee of an individual;

a first thigh portion for covering at least a first portion of a thigh of the individual, the first thigh portion being positioned adjacent the knee portion;

a second thigh portion for covering at least a second portion of the thigh, the second thigh portion being positioned adjacent the first thigh portion and opposite the knee portion;

an elastic member extending across the first thigh portion, the elastic member being formed of an elastic material;

a pair of substantially parallel straps that are formed from a substantially inextensible material, each of the straps being secured to the knee portion and the second thigh portion, the straps extending between the elastic member and the first thigh portion, and the straps being secured to the elastic member and unsecured to the first thigh portion.

wherein each of the knee portion, the first thigh portion, and the second thigh portion include:

a plate that is formed from a semi-rigid polymer material; and a pad that includes a polymer foam material, the elastic member being secured to the pad of the first thigh portion.

* * * * *